US007940944B2

(12) United States Patent
Song

(10) Patent No.: US 7,940,944 B2
(45) **Date of Patent: *May 10, 2011**

(54) DIRECTIONAL SILICON CONDENSER MICROPHONE HAVING ADDITIONAL BACK CHAMBER

(75) Inventor: Chung Dam Song, Seoul (KR)

(73) Assignee: BSE Co., Ltd., Namdong-gu, Incheon (KR)

( * ) Notice: Subject to any disclaimer, the term of this patent is extended or adjusted under 35 U.S.C. 154(b) by 115 days.

This patent is subject to a terminal disclaimer.

(21) Appl. No.: 11/919,693

(22) PCT Filed: Aug. 7, 2006

(86) PCT No.: PCT/KR2006/003094

§ 371 (c)(1),
(2), (4) Date: Oct. 31, 2007

(87) PCT Pub. No.: WO2007/129788

PCT Pub. Date: Nov. 15, 2007

(65) Prior Publication Data

US 2009/0074222 A1 Mar. 19, 2009

(30) Foreign Application Priority Data

May 9, 2006 (KR) ..... 10-2006-0041658

(51) Int. Cl.
*H04R 25/00* (2006.01)

(52) U.S. Cl. ..... 381/174; 381/175; 381/189; 381/190; 381/191

(58) Field of Classification Search ..... 381/174
See application file for complete search history.

(56) References Cited

U.S. PATENT DOCUMENTS 6,781,231 B2 8/2004 Minervini
(Continued)

FOREIGN PATENT DOCUMENTS

DE 103 03 263 A1 8/2004
(Continued)

OTHER PUBLICATIONS

J.W. Weigold, et al; "A MEMS Condenser Microphone For Consumer Applications" Micro Electro Mechanical Systems, 2006. MEMS 2006 Istanbul. 19th IEEE International Conference on Istanbul, Turkey Jan. 22-26, 2006, Piscataway, NJ, USA, IEEE Jan. 22, 2006 pp. 86-89, XP010914531 ISBN: 978-0-7803-9475-9 abstract, paragraphs [0001], [0002].

(Continued)

*Primary Examiner* — Curtis Kuntz
*Assistant Examiner* — Matthew Eason
(74) *Attorney, Agent, or Firm* — Ladas & Parry LLP

(57) ABSTRACT

A directional silicon condenser microphone having an additional back chamber is disclosed. The directional silicon condenser microphone comprises a case having a front sound hole for passing through a front sound; a acoustic delay device for delaying a phase of a sound; a substrate including a chamber case, a MEMS chip having an additional back chamber formed by the chamber case, an ASIC chip for operating the MEMS chip, a conductive pattern for bonding the substrate to the case, and a rear sound hole for passing through a rear sound; a fixing means for fixing the case to the substrate; and an adhesive for bonding the case and the substrate, wherein the adhesive is applied to an entirety of a bonding surface of the case and the substrate fixed by the fixing means.

8 Claims, 4 Drawing Sheets

U.S. PATENT DOCUMENTS

| | | | | |
|---|---|---|---|---|
| 7,436,054 | B2 * | 10/2008 | Zhe | 257/686 |
| 2003/0021432 | A1 | 1/2003 | Scheeper et al. | |
| 2004/0046245 | A1 | 3/2004 | Minervini | |
| 2004/0202345 | A1 | 10/2004 | Stenberg et al. | |
| 2005/0018864 | A1 * | 1/2005 | Minervini | 381/175 |
| 2005/0025328 | A1 | 2/2005 | Song | |
| 2007/0040231 | A1 * | 2/2007 | Harney et al. | 257/415 |

FOREIGN PATENT DOCUMENTS

| | | | |
|---|---|---|---|
| EP | 0 613 196 | A2 | 8/1994 |
| EP | 1 047 295 | A2 | 10/2000 |
| JP | 2-63590 | U | 5/1990 |
| JP | 2000-048952 | A | 2/2000 |
| JP | 2000-307022 | A | 11/2000 |
| JP | 2001-083004 | A | 3/2001 |
| JP | 2003-508997 | A | 3/2003 |
| JP | 2004-200766 | | 7/2004 |
| JP | 20007-178221 | A | 7/2007 |
| JP | 2008-510427 | T | 4/2008 |
| WO | 01/19133 | A1 | 3/2001 |
| WO | 03/090281 | A2 | 10/2003 |
| WO | WO 2005 086535 | | 9/2005 |
| WO | 2006/023016 | A1 | 3/2006 |

OTHER PUBLICATIONS

Japanese Office Action, Appln. No. 2008-514568, mailed Oct. 5, 2010 with concise statement of revelance for ref. JP2-63590.

European Search Report: EP 06 78 3527.

European Search Report: EP 10 00 0467.

* cited by examiner

DIRECTIONAL SILICON CONDENSER MICROPHONE HAVING ADDITIONAL BACK CHAMBER

TECHNICAL FIELD

The present invention relates to a condenser microphone, and more particularly to a directional silicon condenser microphone having an additional back chamber.

BACKGROUND ART

Generally, a condenser microphone widely used in a mobile communication terminal and an audio system comprises a voltage bias element, a pair of a diaphragm and backplate for constituting a capacitor C varying according to a sound pressure, and a JFET (Junction Field Effect Transistor) for buffering an output signal. The conventional condenser microphone is assembled by sequentially inserting a vibrating plate, a spacer ring, an insulation ring, a backplate and a conductive ring in a case, and finally inserting a PCB and curling an end portion of the case toward the PCB.

Recently, a semiconductor processing technique using micromachining is proposed as a technique for integrating a microscopic device. A MEMS (Micro Electro Mechanical System) employs a semiconductor manufacturing process, an integrated circuit technology, in particular, to manufacture a microscopic sensor, an actuator and an electromechanical structure having a size in units of microns. In accordance with a MEMS chip microphone manufactured via the micromachining technology, conventional components of the microphone such as the vibrating plate, the spacer ring, the insulation ring, the backplate and the conductive ring may be miniaturized and integrated, and may have high performance, multi-function, high stability and a high reliability through a high precision microscopic process.

FIG. 1 is a diagram exemplifying a conventional MEMS chip structure used in a silicon condenser microphone. Referring to FIG. 1, a MEMS chip 10 has a structure wherein a backplate 13 is formed on a silicon wafer 14 using MEMS technology, and a vibrating plate 11 is disposed having a spacer 12 therebetween. The backplate 13 includes a sound hole 13*a* formed therein, and the MEMS chip 10 is generally manufactured by micromachining technology and a semiconductor chip manufacturing technology.

FIG. 2 is a lateral cross-sectional view illustrating a conventional silicon condenser microphone employing the MEMS chip. Referring to FIG. 2, a conventional silicon condenser microphone 1 is assembled by mounting the MEMS chip 10 and an ASIC (application specific integrated circuit) chip 20 on a PCB 40 and inserting the same in a case 30 having a sound hole 30*a* formed therein.

However, as shown in FIG. 2, because a back chamber 15 of the conventional silicon condenser microphone 1 is formed by the MEMS chip 10, a space of the back chamber 15 is extremely small due to a size of the MEMS chip 10 which is a semiconductor chip. Therefore, a sound quality of the microphone is degraded.

SUMMARY

It is an object of the present invention to provide a directional silicon condenser microphone having an additional back chamber in order to improve an acoustic characteristic.

In order to achieve the above-described object, there is provided a directional silicon condenser microphone comprising: a case having a front sound hole for passing through a front sound; an acoustic delay device for delaying a phase of a sound; a substrate including a chamber case, a MEMS chip having an additional back chamber formed by the chamber case, an ASIC chip for operating the MEMS chip, a conductive pattern for bonding the substrate to the case, and a rear sound hole for passing through a rear sound; a fixing means for fixing the case to the substrate; and an adhesive for bonding the case and the substrate, wherein the adhesive is applied to an entirety of a bonding surface of the case and the substrate fixed by the fixing.

As described above, the present invention includes a chamber case for forming an additional back chamber under a MEMS chip in order to increase a back chamber space of the MEMS chip, thereby improving sensitivity and noise problems such as a THD (Total Harmonic Distortion). In addition, the directional silicon microphone in accordance with the present invention may be mounted on a main PCB via various methods. Therefore, a mounting space may be small. Moreover, since the case is fixed to a PCB by laser welding and bonded by an adhesive, the case is fixed during the bonding to prevent a generation of a defect, and a mechanical firmness is improved due to a high bonding strength. Thereby the silicon condenser microphone in accordance with the present invention is robust to external noise, and reduces a processing cost and the manufacturing cost.

While the present invention has been particularly shown and described with reference to the preferred embodiment thereof, it will be understood by those skilled in the art that various changes in form and details may be effected therein without departing from the spirit and scope of the invention.

DETAILED DESCRIPTION OF PREFERRED EMBODIMENTS

The above-described objects and other objects and characteristics and advantages of the present invention will now be described in detail with reference to the accompanied drawings.

Typically, the direction condenser microphone includes an acoustic delay device. Embodiments of the present invention will be described by dividing into two examples, an example wherein the acoustic delay device is mounted at a front sound hole of a case for passing through a front sound and an example wherein the acoustic delay device is mounted at a rear sound hole of a PCB for passing through a rear sound.

Figure 3:
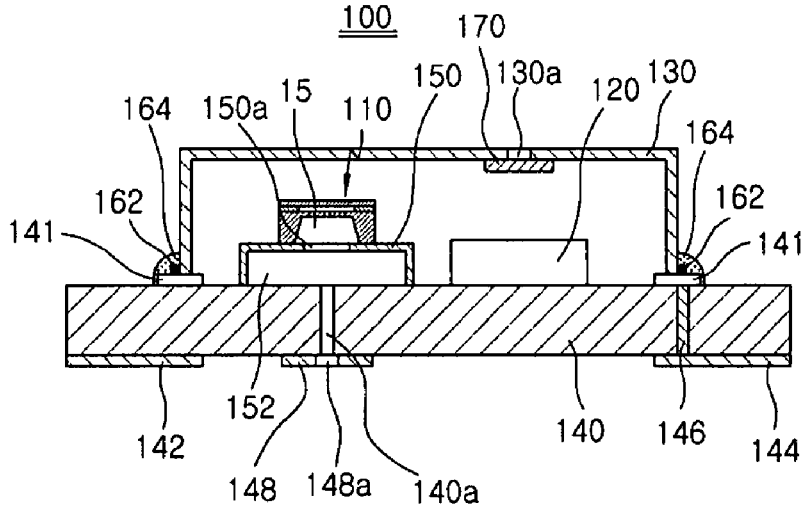
FIG. 3 is a lateral cross-sectional view illustrating a directional silicon condenser microphone having an additional back chamber in accordance with a first embodiment of the present invention.

FIG. 3 is a lateral cross-sectional view illustrating a directional silicon condenser microphone having an additional back chamber in accordance with a first embodiment of the present invention, wherein an acoustic delay device 170 is installed at a front sound hole 130*a* of the case for passing through the front sound.

Referring to FIG. 3, the directional silicon condenser microphone 100 having an additional back chamber 152 in accordance with the first embodiment has a structure wherein a chamber case 150 for forming the additional back chamber 152 and an ASIC chip 120 for driving an electrical signal of a MEMS chip 110 are disposed on a PCB substrate 140 having a conductive pattern 141 and connection terminals 142 and 144, a MEMS chip 110 is disposed on the chamber case 150, and a case 130 having the front sound hole 130*a* for passing through the front sound is attached to the PCB substrate 140. The acoustic delay device 170 is attached at the front sound hole 130*a* inside the case, and the conductive pattern 141 and the ground connection terminal 144 are connected via a through-hole 146.

Figure 1:
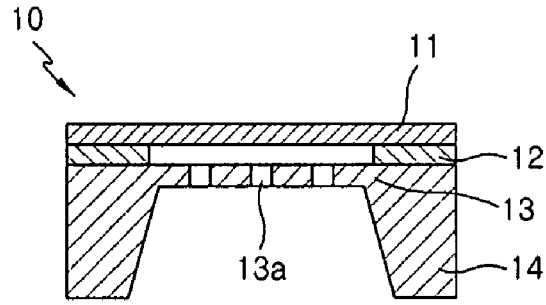
Figure 1 (Prior Art)
FIG. 1 is a diagram exemplifying a conventional MEMS chip structure used in a silicon condenser microphone.
Figure 2:
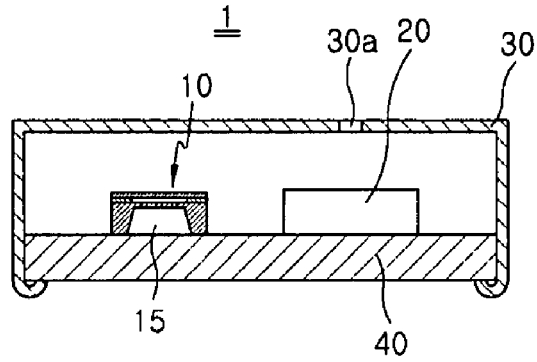
Figure 2 (Prior Art)
FIG. 2 is a lateral cross-sectional view illustrating a conventional silicon condenser microphone employing a MEMS chip.

The chamber case 150 increases a space of the back chamber of the MEMS chip 110 to improve a sensitivity and improve a noise problem such as THD (Total Harmonic Distortion), wherein a through-hole 150*a* for connecting a back chamber 15 formed by the MEMS chip 110 with the additional back chamber 152 is disposed on an upper surface of the chamber case 150, and the MEMS chip 110 has a structure wherein the backplate 13 is formed on the silicon wafer 14 using the MEMS technology and the vibrating plate 11 is formed to have the spacer 12 therebetween as shown in FIG. 1. The chamber case 150 may have a shape of a square pillar or a cylinder, and may be manufactured using a metal or a mold resin. In addition, although not shown, electrical wiring is disposed on the chamber case 150 so as to transmit the electrical signal of the MEMS chip 110 to the ASIC chip 120.

The chamber case 150 having the through-hole 150*a* on an upper surface thereof for forming the additional back chamber, the MEMS chip 110 attached on the through-hole 150*a* of the chamber case 150 to expand the back chamber, and the ASIC chip 120 are disposed on the PCB substrate 140. The conductive pattern 141 is disposed on a portion of the PCB substrate 140 that is in contact with the case 130. In addition, a rear sound hole 140*a* for passing through the rear sound is disposed at a portion of the PCB substrate 140 where the chamber case 150 is mounted. A sealing pad 148 for carrying out a hole sealing of the sound hole 140*a* for preventing a distortion of a sound wave by soldering may be further disposed around the rear sound hole 140*a* of the PCB substrate 140. A reference numeral 148*a* denotes a sound hole formed by the sealing pad 148.

The case 130 is a metal case having one surface open wherein the case 130 has the shape of the cylinder or the square pillar. The case 130 has an end portion in contact with the conductive pattern 141 of the PCB substrate 140 and has the front sound hole 130*a* for passing through the external front sound at a bottom surface thereof as well. The case 130 is attached to the PCB substrate 140 by aligning the metal case 130 on the conductive pattern 141 formed on the PCB substrate 140 and then spot-welding at least two points by a laser welding or a spot welding and then sealing a contacting portion of the case 130 and the PCB substrate 140 with an adhesive 164 such as an epoxy. A reference numeral 162 denotes a welding point.

In accordance with a method for manufacturing the directional silicon condenser microphone 100 of the first embodiment, after the chamber case 150 is attached such that the rear sound hole 140*a* of the PCB substrate 140 is positioned inside the additional back chamber 152 while mounting the ASIC chip 120, the MEMS chip 110 is attached to the chamber case 150 such that the through-hole 150*a* of the chamber case 150 is positioned inside the back chamber 15 of the MEMS chip 110.

Thereafter, the acoustic delay device 170 is attached to the front sound hole 130*a* of the case 130 having the shape of the cylinder or the square pillar, and the case 130 having the shape of the cylinder or the square pillar is fixed to the conductive pattern 141 of the PCB substrate 140 by the laser welding. The case 130 is bonded to the PCB substrate 140 by the adhesive 164. The adhesive 164 may be a conductive epoxy, a non-conductive epoxy, a silver paste, a silicon, a urethane, an acryl and/or a cream solder.

Referring to FIG. 3, the MEMS chip 110 having the additional back chamber 152 formed by the chamber case 150 and the ASIC chip 120 are disposed on the PCB substrate 140, and the square or circular conductive pattern 141 is disposed at a portion that is in contact with the case 130 having the shape of the cylinder or the square pillar.

Since a size of the PCB substrate 140 is larger than that of the case 130 having the shape of the cylinder or the square pillar, a connection pad or the connection terminal for connecting to an external device may be freely disposed on the large PCB substrate, and the conductive pattern 141 may be manufactured by disposing a copper film via a conventional PCB manufacturing process and then plating a nickel or a gold. A ceramic substrate, a flexible PCB (FPCB) substrate or a metal PCB may be used instead of the PCB substrate 140.

The case 130 having the shape of the cylinder or the square pillar has a contacting surface with the PCB substrate 140 open such that chip components may be housed inside, wherein the front sound hole 130*a* for passing through the front sound is disposed thereon. The case 130 may be manufactured using a brass, a copper, a stainless steel, an aluminum or a nickel alloy and may be plated with gold or silver.

After aligning the case 130 to the conductive pattern 141 of the PCB substrate 140, a welding point 162 which is a portion of the contacting portion is welded with the laser using a laser welder (not shown) to fix the case 130 to the PCB substrate 140. Thereafter, an assembly of the microphone is complete by applying the adhesive 164 to the entire contacting portion. The welding refers to spot-welding one or more points (preferably two or four points) in order to fix the case 130 to the PCB substrate 140 rather than welding an entire contacting surface of the case 130 and the PCB substrate 140. A bonding point formed between the case 130 and the PCB substrate 140 through such welding is referred to as the welding point 162. The case 130 is fixed to the PCB substrate 140 by the welding point 162 such that the case 130 is not moved during a bonding using the adhesive 164 or a curing process for bonding at a proper position. In addition, the conductive pattern 141 is connected to the ground connection terminal 144 through the through-hole 146, and when the case 130 is bonded, external noise is blocked to remove the noise.

At least two and up to eight connection terminals 142 and 144 for connecting to the external device may be formed at a bottom surface of the PCB substrate 140, and each of the connection terminals 142 and 144 is electrically connected to a chip component side through the through-hole. Particularly, in accordance with the embodiments of the present invention, when the connection terminals 142 and 144 extends about the PCB substrate 140, the rework may be facilitated by using an electric solder through an exposed surface.

In accordance with the embodiments of the present invention, while the laser welding is exemplified as a method for fixing the case 130 to the PCB substrate 140, a soldering or a punching may be used for fixing the case 130 to the PCB substrate 140, and the conductive epoxy, the non-conductive epoxy, the silver paste, the silicon, the urethane, the acryl or the cream solder may be used as the adhesive 164.

Figure 4:
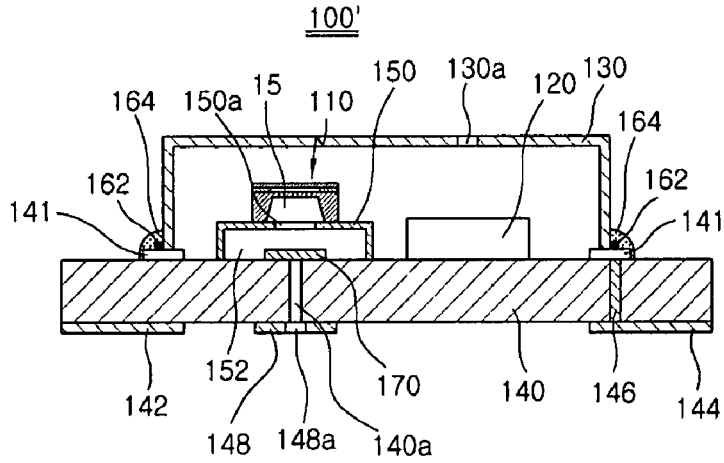
FIG. 4 is a lateral cross-sectional view illustrating a directional silicon condenser microphone having an additional back chamber in accordance with a second embodiment of the present invention.

FIG. 4 is a lateral cross-sectional view illustrating a directional silicon condenser microphone 100' having an additional back chamber in accordance with a second embodiment of the present invention. As described above, the silicon condenser microphone 100 of the first embodiment differs from the silicon condenser microphone 100' of the second embodiment in a position of the acoustic delay device 170, wherein the acoustic delay device 170 is attached to the front sound hole 130*a* of the case 130 for passing through the front sound in the first embodiment, and is attached to the rear sound hole 140*a* of the PCB for passing through the rear sound in the second embodiment.

Therefore, while the front sound from an external acoustic source that passed through the front sound hole 130*a* of the case is subjected to a phase delay by the acoustic delay device 170 to reach the MEMS chip 110 in the first embodiment, the rear sound from the external acoustic source that passed through the rear sound hole 140*a* of the PCB substrate 140 is subjected to the phase delay by the acoustic delay device 170 to reach the MEMS chip 110 in the second embodiment.

In accordance with the silicon condenser microphone of the second embodiment, since a constitution thereof is identical to that of the silicon condenser microphone of the first embodiment except the position of the acoustic delay device 170, an additional detailed description is omitted.

Figure 5:
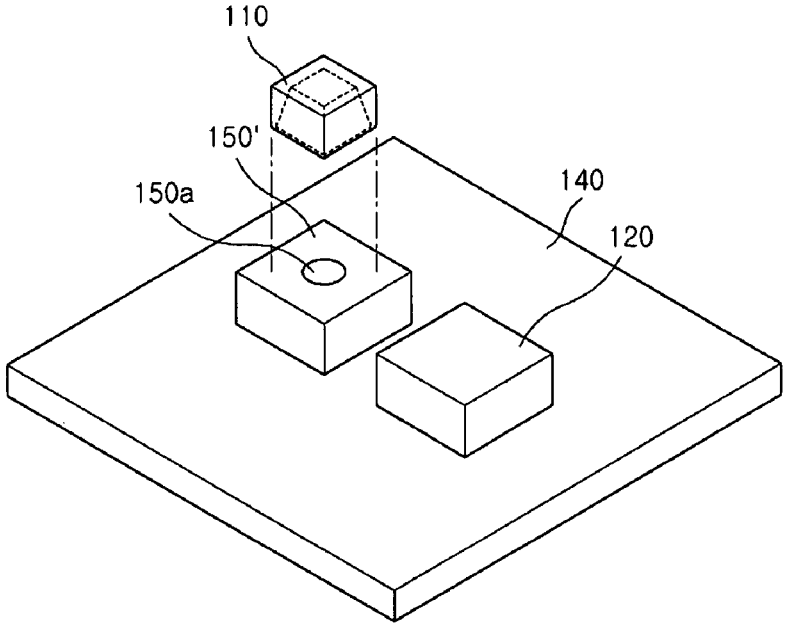
FIG. 5 is a diagram exemplifying an additional back chamber in a form of a square pillar in accordance with the present invention.
Figure 6:
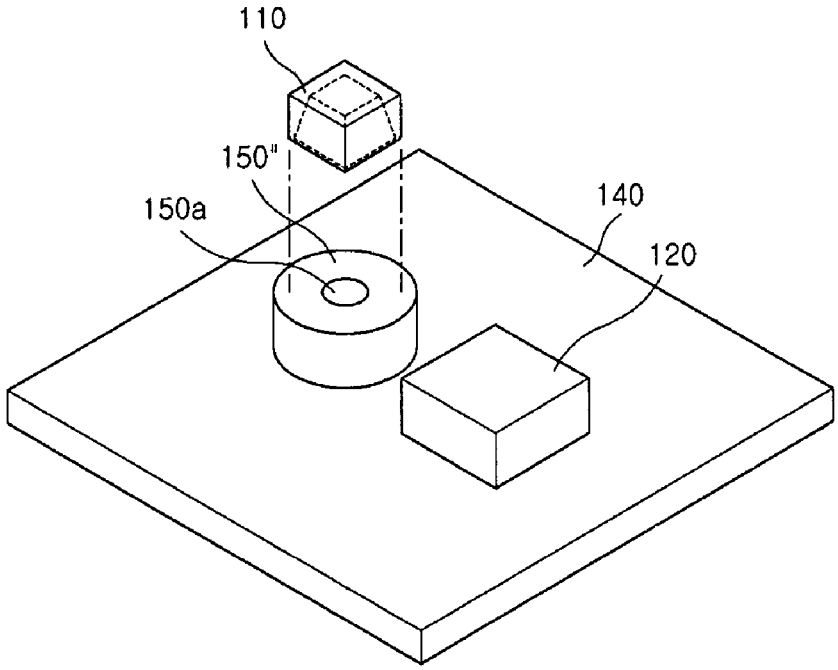
FIG. 6 is a diagram exemplifying an additional back chamber in a form of a cylinder in accordance with the present invention.

FIG. 5 is a diagram exemplifying an additional back chamber in a form of a square pillar in accordance with the present invention, and FIG. 6 is a diagram exemplifying an additional back chamber in a form of a cylinder in accordance with the present invention.

As shown in FIGS. 5 and 6, the chamber case 150 for forming the additional back chamber 152 may have the shape of the square pillar 150' and the cylinder 150" and the through-hole 150*a* is disposed on an upper portion of the square pillar 150' or the cylinder 150" to form a path with the back chamber 15 of the MEMS chip 110.

The silicon condenser microphone 100 having various shapes may be manufactured by attaching the case 130 having various shapes on the PCB substrate 140. The ASIC chip 120 and the MEMS chip 110 are mounted on the PCB substrate 140. The MEMS chip 110 includes the additional back chamber 152 by the chamber case 150. For instance, the case may have the shape of the cylinder, the square pillar, a cylinder having a wing at an end thereof, or a square pillar having a wing at an end thereof.

Figure 7:
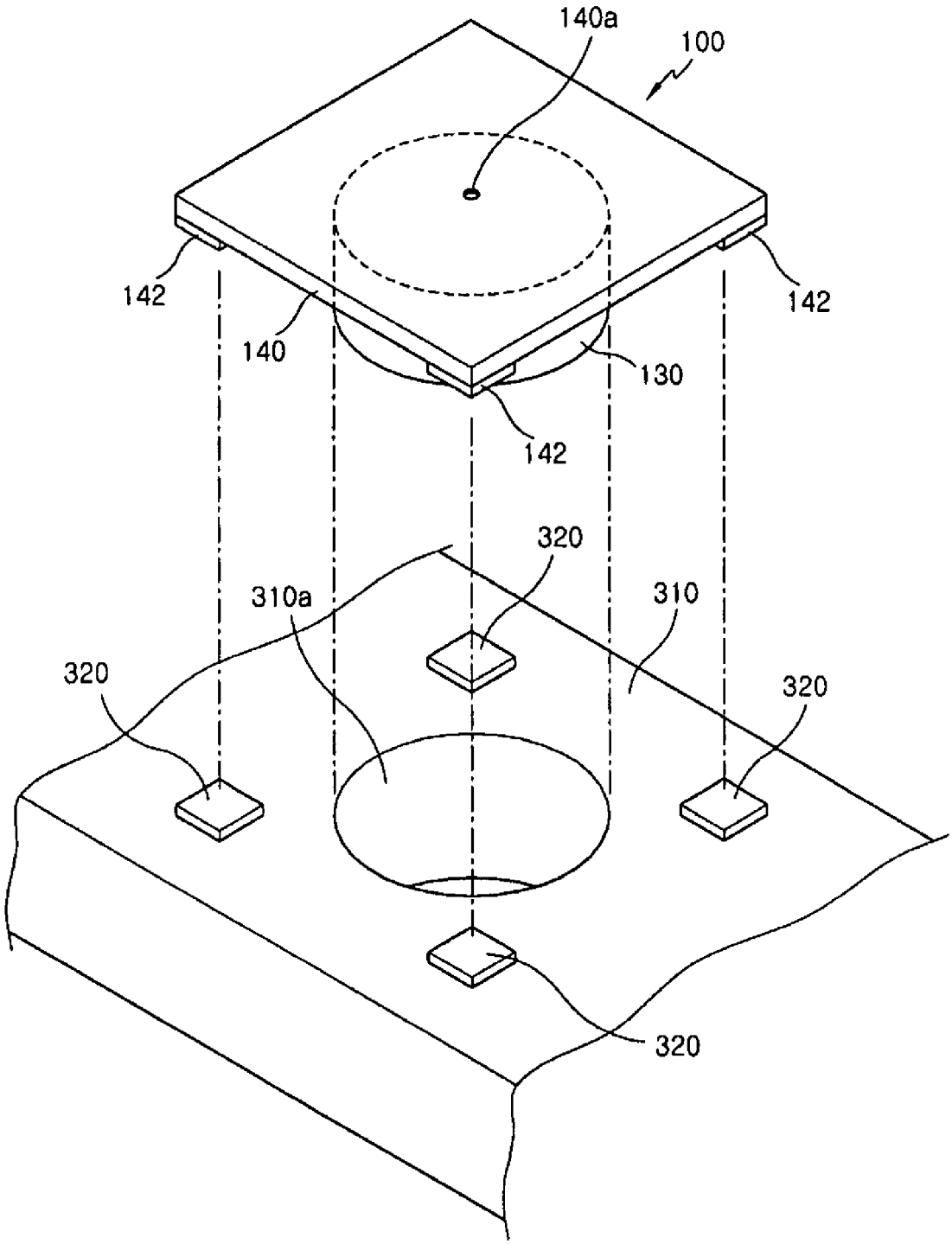
FIG. 7 is a perspective view illustrating an example wherein a directional silicon condenser microphone is mounted on a main PCB in accordance with the embodiment of the present invention.

As shown in FIG. 7, in accordance with the directional silicon condenser microphone mounted on the main PCB 310, the connection pad 320 of the main PCB 310 is coupled to the connection terminals 142 and 144 by a soldering as well as the case 130 extruding at a center of the PCB substrate 140 is inserted the inserting hole 310*a* of the main PCB 310.

Therefore, in accordance with a mounting method of the present invention, since the case 130 extruding over the PCB substrate of the microphone is inserted in the inserting hole 310*a* of the main PCB 310, an overall height after the mounting is smaller than the conventional microphone wherein the connection terminals are formed on an opposite side of the component side to be mounted the main PCB, resulting in an efficient use of a space required for mounting the product.

The present invention includes a chamber case for forming an additional back chamber under a MEMS chip in order to increase a back chamber space of the MEMS chip, thereby improving sensitivity and noise problems such as a THD (Total Harmonic Distortion).

The invention claimed is:

1. A directional silicon condenser microphone comprising:
- a case having a front sound hole for passing through a front sound;
- an acoustic delay device for delaying a phase of a sound;
- a substrate;
- a chamber case located on top of the substrate;
- a Micro Electro Mechanical System (MEMS) chip having an additional back chamber formed by the chamber case;
- an application specific integrated circuit (ASIC) chip for operating the MEMS chip;
- a conductive pattern for bonding the substrate to the case;
- the substrate including a rear sound hole for passing through a rear sound;
- a fixing means for fixing the case to the substrate; and
- an adhesive for bonding the case and the substrate, wherein the adhesive is applied to an entirety of a bonding surface of the case and the substrate fixed by the fixing means.

2. The microphone in accordance with claim 1, wherein the rear sound hole is disposed on a position of the substrate corresponding to the additional back chamber.

3. The microphone in accordance with claim 1, wherein a sealing pad is disposed around the front sound hole and the rear sound hole for preventing a distortion of a sound wave.

4. The microphone in accordance with claim 1, wherein the fixing means comprises a welding point formed by a laser welding or a soldering, and the adhesive comprises one of a conductive epoxy, a non-conductive epoxy, a silver paste, a silicon, a urethane, an acryl and a cream solder.

5. The microphone in accordance with claim 1, wherein the case has a shape of a cylinder or a square pillar, and wherein an end portion of the case is a straight type or curled outward to form a wing.

6. The microphone in accordance with claim 1, wherein the substrate comprises one of a printed circuit board (PCB), a ceramic substrate, a flexible PCB (FPCB) substrate and a metal PCB.

7. The microphone in accordance with claim 1, wherein the acoustic delay device is attached around the front sound hole or the rear sound hole.

8. A directional silicon condenser microphone comprising:
- a case having a front sound hole for passing through a front sound;
- an acoustic delay device for delaying a phase of a sound;
- a substrate including a chamber case, a Micro Electro Mechanical System (MEMS) chip having an additional back chamber formed by the chamber case, an application specific Integrated circuit (ASIC) chip for operating the MEMS chip, a conductive pattern for bonding the substrate to the case, and a rear sound hole for passing through a rear sound, wherein the chamber case comprises a cylindrical chamber case or a square pillar chamber case, and comprises a through-hole connected to a back chamber of the MEMS chip;
- a fixing means for fixing the case to the substrate; and
- an adhesive for bonding the case and the substrate, wherein the adhesive is applied to an entirety of a bonding surface of the case and the substrate fixed by the fixing means.

* * * * *